United States Patent [19]

Koyanagi

[11] Patent Number: 4,850,912

[45] Date of Patent: Jul. 25, 1989

[54] CONTAINER FOR SEALINGLY CONTAINING A FLUID

[76] Inventor: Toshimichi Koyanagi, c/o Kabushikikaisha kashiharaseitai 1-13-5, Taiheiji, Kashihara-shi, Osaka-fu, Japan

[21] Appl. No.: 164,495

[22] Filed: Mar. 4, 1988

[30] Foreign Application Priority Data

Oct. 30, 1987 [JP] Japan ..... 62-166261[U]

[51] Int. Cl.[4] ..... A41D 13/00

[52] U.S. Cl. ..... 441/40; 441/41; 137/512.15

[58] Field of Search ..... 441/40, 41, 80, 90, 441/96, 92, 99, 129, 35; 114/345; 5/449, 455, 456; 137/512.15

[56] References Cited

U.S. PATENT DOCUMENTS 3,895,396 7/1975 Amarantos ..... 441/96

4,674,532 6/1987 Koyanagi ..... 137/512.15

*Primary Examiner*—Joseph F. Peters, Jr.

*Assistant Examiner*—Edwin I. Swinehart

*Attorney, Agent, or Firm*—Larson and Taylor

[57] ABSTRACT

A container for sealingly containing a fluid is made from first and second thermoplastic container films bonded together around a rectangular periphery except where an inlet port is formed. A first bonded together portion extends the inlet port along one side, with a plurality of non-bonded together segments spaced therealong. A check valve is provided in each non-bonded together segment. The check valve is made from two rectangular thermoplastic valve films bonded together to form a fluid pipe. The fluid pipe has a tip opening and a valve body to allow flow through the fluid pipe from the tip opening but which prevents a reverse flow. A respective valve film is bonded at the tip opening to an adjacent container film so that the guide tube is fluid tight except for the inlet port and the tip openings. Second bonded together portions are also provided between adjacent check valves in order to form a plurality of container members whose only egress is a respective check valve. Preferably, the width of the second bonded together portion is substantially larger than the first bonded together portion to allow cutting thereof. In addition, the valve body is a folded over rectangular thermoplastic film defining two flaps whose respective lateral sides are bonded to a respective overlapping adjacent long side of the fluid pipe. An intermediate bonded together portion of the flaps can also be provided.

4 Claims, 6 Drawing Sheets

CONTAINER FOR SEALINGLY CONTAINING A FLUID

BACKGROUND OF THE INVENTION

There have been known a variety of containers for sealingly containing gas or a liquid.

When a container is used as a material of, for example, a lifesaving buoy, a boat or the like, the container is designed such that all the air contained therein is sealed by a valve or a stopper disposed inside or outside of the container.

In such conventional arrangement, if a lifesaving buoy, a boat or the like is damaged at a portion thereof, all the air sealed therein flows out. This is very dangerous, lacking the safety. Such problem also applies to a buffer material, an air pillow or the like formed by filling the container with air. The outflow of all the fluid sealed in the container through one damaged portion thereof presents a great disadvantage.

SUMMARY OF THE INVENTION

The present invention relates to a container for sealingly containing a fluid, and more particularly to improvements in such containers which can be applied to a variety of purposes as a material for making a buffer material, a lifesaving buoy, a boat or the like, or as a packing material for a popsicle raw material liquid or the like.

It is an object of the present invention to provide a container for sealingly containing a fluid, in which even though the container is broken at a portion thereof, all the fluid does not flow out but only a portion of the fluid is discharged, enabling the container in its entirety to achieve the sealing function as required.

It is another object of the present invention to provide a container for sealingly containing a fluid, in which, while keeping the fluid sealing function, the container can be divided into a plurality of portions according to the purpose, enabling the container to be conveniently used as necessary.

The container for sealingly containing a fluid in accordance with the present invention comprises:

a flat-shaped fluid guide tube provided at one end thereof with a fluid inlet port and at the other end thereof with a closed portion, the guide tube being made of plastic films; and a plurality of sac-like container members of plastic films disposed in parallel to one another at at least one side of the guide tube along the fluid flowing direction thereof, the sac-like container members being formed in a unitary structure, each sac-like container member incorporating a check valve of plastic films;

the guide tube and the sac-like container members communicating with each other only through passages in the check valves, adjacent sac-like container members being integrally connected to each other at the lateral sides thereof.

According to the container for sealingly containing a fluid of the present invention, when a fluid, for example air, is supplied to the container through the inlet port of the guide tube, the air passes through the guide tube and is sent to the sac-like container members successively in order from the innermost part to the outermost part, through passages in the check valves. Thus, all sac-like container members are filled with the air. The air in the sac-like container members is prevented from flowing backward toward the guide tube by the operation of the check valves. Each of the sac-like container members is sealingly filled with air. Therefore, even though one sac-like container member is broken to discharge the air, the air in the remaining sac-like container members is not discharged. Thus, the container in its entirety achieves the function of sealing a fluid. Further, when the sac-like container members are connected to one another with a melted portion of a predetermined width disposed between two adjacent sac-like container members, the container can be cut at one or more melted portions and divided into a plurality of portions each having a suitable size.

The container for sealingly containing a fluid in accordance with the present invention may achieve the following results:

(1) Supplying a fluid through the inlet port of the guide tube enables a plurality of sac-like container members to be filled with the fluid efficiently at one time, and the check valves prevent the fluid once supplied from unexpectedly flowing out.

(2) Even though one sac-like container member among a plurality of sac-like container members is broken, the fluid in such peculiar sac-like container member only flows out, and the container in its entirety can otherwise seal the fluid. Accordingly, when such container is used as a material of a lifesaving buoy, a boat, a balloon or the like, the safety can be greatly improved. It is a matter of course that such function of sealing a fluid is achieved not only for gas but also for a liquid.

(3) When the sac-like container members are connected to one another with a melted portion of a predetermined width disposed between two adjacent sac-like container members, the container can be cut and divided into two or more portions at such melted portions without outflow of the sealed fluid. Accordingly, if the container is too large in its entirety, it can be divided into two or more portions each having a suitable size. It is very convenient to use such sac-like container members as a packing buffer material or for subdividing the contents of the container. Thus, the buffer effect and the manipulation of the container contents can be greatly improved.

DETAILED DESCRIPTION OF THE PREFERRED EMBODIMENTS

Figure 1:
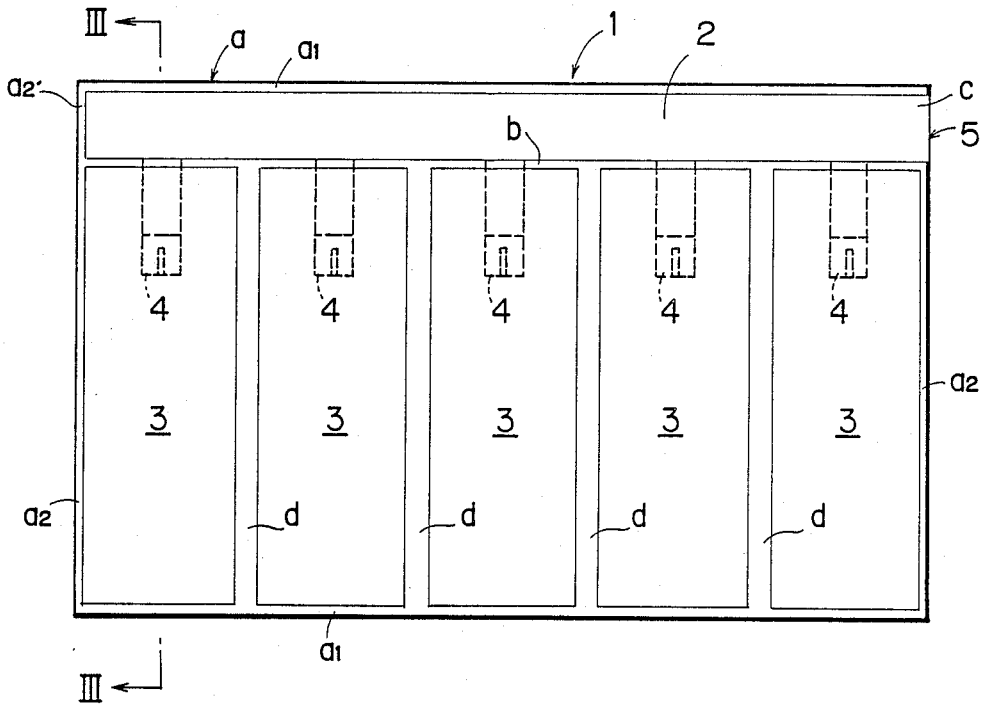
FIG. 1 is a front view of a container for sealingly containing a fluid in accordance with a first embodiment of the present invention.

In the first embodiment shown in FIGS. 1 to 6, a container 1 for sealingly containing a fluid in accordance with the present invention comprises:

a flat-shape fluid guide tube 2 made of two rectangular thermoplastic films (sheets) overlapping each other and melted together at predetermined portions thereof;

a plurality of sac-like container members 3 disposed in parallel to one another along one side of the guide tube 2 in the fluid flowing direction (longitudinal direction); and check valves 4 disposed in the sac-like container members 3 at the connection edges thereof.

The guide tube 2 has:

one long-side melted together portion $a_1$ of a peripheral melted together portion a of the plastic films;

a melted together portion b parallel to the portion $a_1$ at a slightly inner part thereof;

a portion $a_2$ of one short-side molten portion $a_2$ of the peripheral molten portion a; and a non-melted together portion c of the other short-side $a_2$ between the molten portion b and said one long-side portion $a_1$.

Thus, the guide tube 2 is formed in a flat slender tube member provided at one end thereof with a fluid inlet port 5 formed by the portion c and at the other end thereof with a closed portion 6 formed by the portion $a_{2'}$.

A plurality of sac-like container members 3 include:

the other long-side melted together portion $a_1$ of the peripheral portion a of the plastic films;

the portion b;

both short-side portions $a_2$; and a plurality of slightly wide melted together portions d arranged at predetermined spaced intervals and extending over the other long-side molten portion $a_1$ and the portion b.

The portion b forming the upper edges of the sac-like container members 3 has non-melted together portions e each of which is located at the center of each of the sac-like container members 3. These portions e enable check valves 4 (to be discussed later) to be respectively mounted in the sac-like container members 3.

As shown in FIG. 6 and FIGS. 9 to 12, each of the check valves 4 comprises a fluid pipe 7 of predetermined width and length formed into a flat shape and made of a soft and thin plastic film such as a polyethylene film, and a valve body 8 disposed in the fluid pipe 7. The valve body 8 is a folded piece of a plastic film which is the same as the material of the fluid pipe 7. The valve body 8 is provided with a closed portion 9 and an opening portion 10 respectively at the tip and base sides in the flowing direction of a fluid which flows in the fluid pipe 7. Gaps 11 are formed between the inner surfaces 7*a* of the fluid pipe 7 and the outer surfaces 8*a* of the valve body 8. A fluid may flow in and out through these gaps 11.

In order to securely prevent the fluid from flowing backward, the check valve 8 has one or more bonding portions 12 at which the outer surfaces 8*a* of the valve body 8 are bonded to the inner surfaces 7*a* of the fluid pipe 7, the bonding portions 12 being spaced from one another in the widthwise direction.

Figure 12:
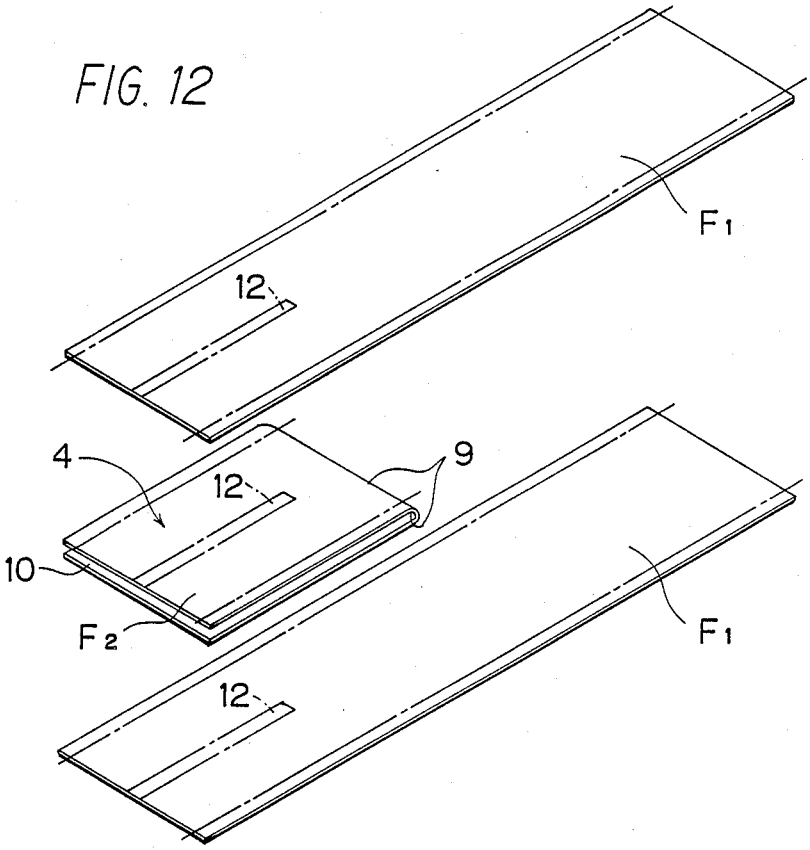
FIG. 12 is an exploded perspective view of the check valve.

FIG. 12 is an exploded view of the check valve 4 from which it can be easily understood how the check valve 4 is made, by way of example.

In this example, in order to facilitate the manufacture of the check valve 4 having the arrangement above-mentioned, the fluid pipe 7 is made of two plastic films $F_1$, and the valve body 8 is made of one plastic film $F_2$ as folded. The folded piece disposed along the fluid flowing direction is held by and between the films $F_1$, and both lateral sides of the films $F_1$ and $F_2$ are simultaneously heated and bonded to one another. The check valve having the arrangement above-mentioned is thus formed.

Figure 2:
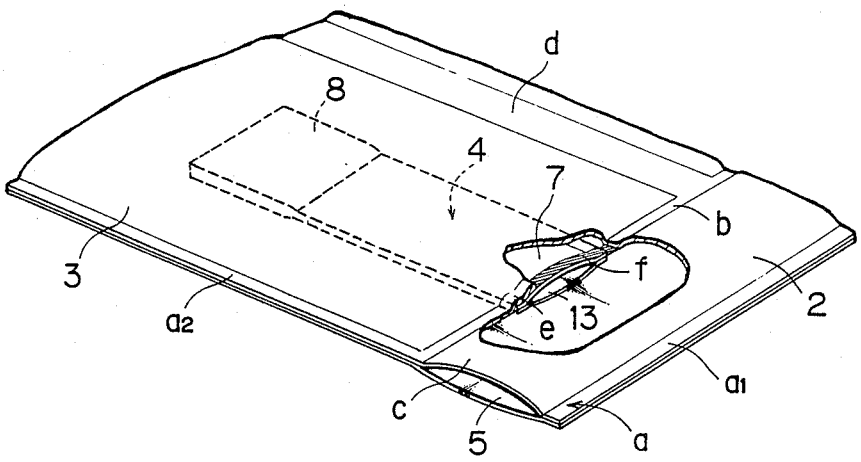
FIG. 2 is a partially enlarged perspective view, with portions broken away, of the container in FIG. 1.
Figure 3:
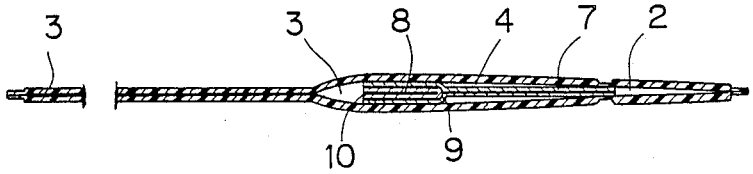
FIG. 3 is an enlarged section view, with portions omitted, taken along the line III—III in FIG. 1.
Figure 4:
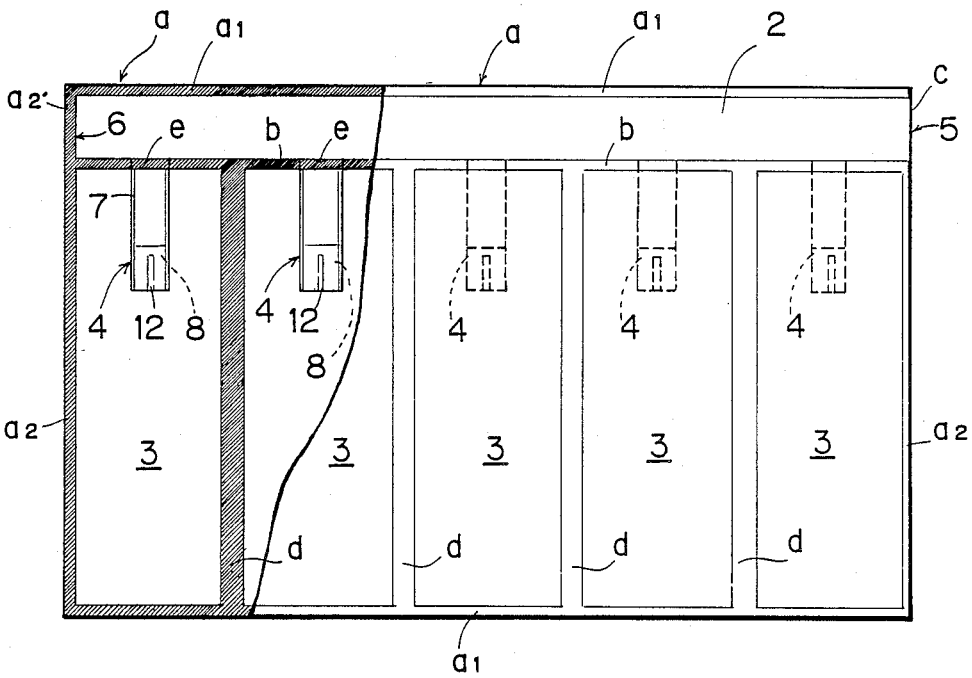
FIG. 4 is a front view with portion broken away, of the container in FIG. 1.
Figure 5:
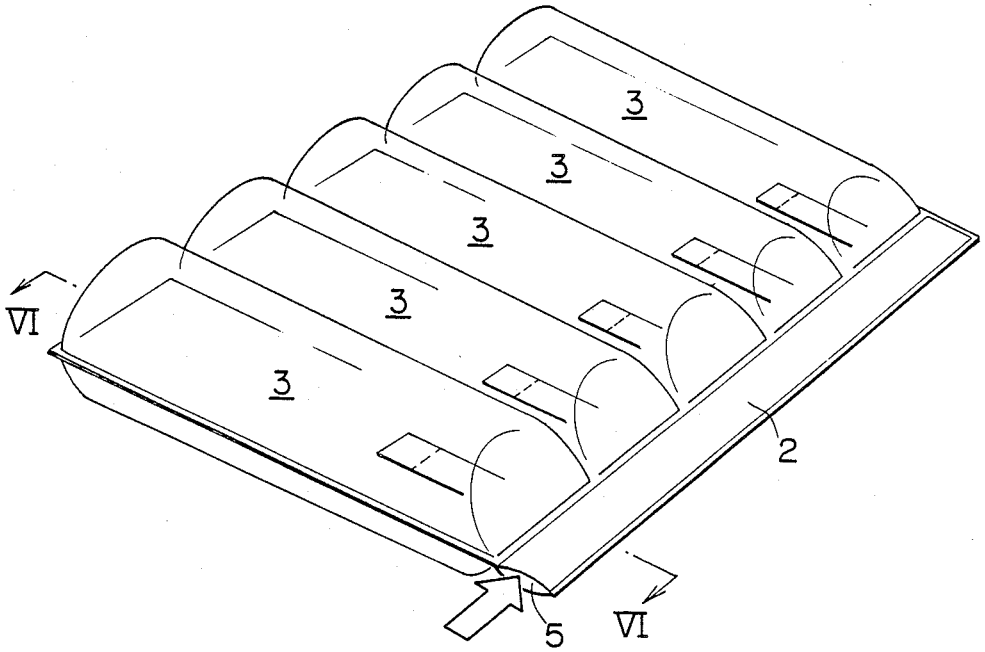
FIG. 5 is a perspective view of the container filled with air.
Figure 6:
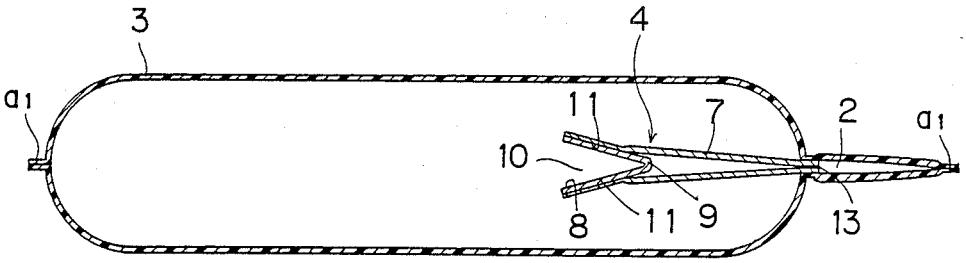
FIG. 6 is an enlarged section view taken along the line VI—VI in FIG. 5.

As shown in FIG. 2, with the folded portion (closed portion) of the folded piece faced to the guide tube 2, the check valve 4 is disposed in each of the sac-like container members 3 through the portion e at the portion b. The outer periphery of a tip opening 13 of the fluid pipe 7 of the check valve 4 is melted at f to the inner surface of the portion e. Thus, the check valve 4 is disposed in each of the sac-like container members 3. Each of the sac-like container members 3 communicates with the guide tube 2 only through the gaps 11 and a passage formed by the tip opening 13 of the check valve 4. Thus, there is formed a container for sealingly containing a fluid having a plurality of sac-like container members 3 in parallel to one another at one side of the guide tube 2 such that the sac-like container members 3 communicate with the guide tube 2 only through the passages of the check valves 4.

When blowing gas into the sac-like container members 3 of the container having the arrangement above-mentioned, it is enough to supply gas by inserting gas supply means into the inlet port 5 of the guide tube 2. The gas thus supplied passes through the guide tube 2 and is sent first to the innermost sac-like container member 3 through the passage of the check valve 4 thereof. The gas is smoothly supplied to all sac-like container members in succession in order from the innermost part to the outermost part. Thus, the sac-like container members 3 are filled with the gas (See FIGS. 5 and 6). When the gas supply means is removed upon completion of gas supply, the gas in the sac-like container members 3 tends to flow out by the pressure of the gas. However, the valve bodies 8 have at the tips thereof the folded or closed portions 9 which form the dead end. Therefore, the gas expands the valve bodies 8 to hermetically seal the gaps 11, thereby to prevent the fluid from flowing out (See FIGS. 6 and 11 (*b*)).

Even if the gaps 11 should be insufficiently sealed to allow a portion of the gas to flow outside, the pressure of the gas in container member 3 acts on the outer surface (up to melted portion f) of the fluid pipes 7 of the check valves to close tight the fluid pipes 7. Thus, gas outflow can be securely prevented in two stages.

According to this embodiment, the inner surfaces of the fluid pipes 7 and the outer surfaces of the valve bodies 8 are partially bonded to each other at one or more portions spaced in the widthwise direction. Therefore, the widths of the gaps 11 are narrowed to prevent the fluid from flowing backward.

The following description will discuss the operation and results of the embodiment above-mentioned.

Each of the sac-like container members disposed at one side of the guide tube 2 has the check valve 4. Even though any one of the sac-like container members 3 is broken to discharge the gas outside, this exerts no influence upon the remaining sac-like container members 3. Accordingly, the container does not lose, in its entirety, the function of sealing a fluid. When the container of the present invention is applied for a lifesaving buoy, a boat or the like, the safety can be considerably improved.

The sac-like container members 3 are disposed side by side with a relatively wide portion d disposed between two adjacent sac-like container members 3. At such portions d, the container can be divided into portions while keeping the sealing ability of the sac-like container members 3. When the container of the present invention is to be used as packing and buffer material, the container can be divided, at one or more portions d, into a plurality of portions each having a suitable size, at a time when an article is packed. This provides a great facility or handiness. Also, this is convenient for subdividing the contents of the container.

Figure 7:
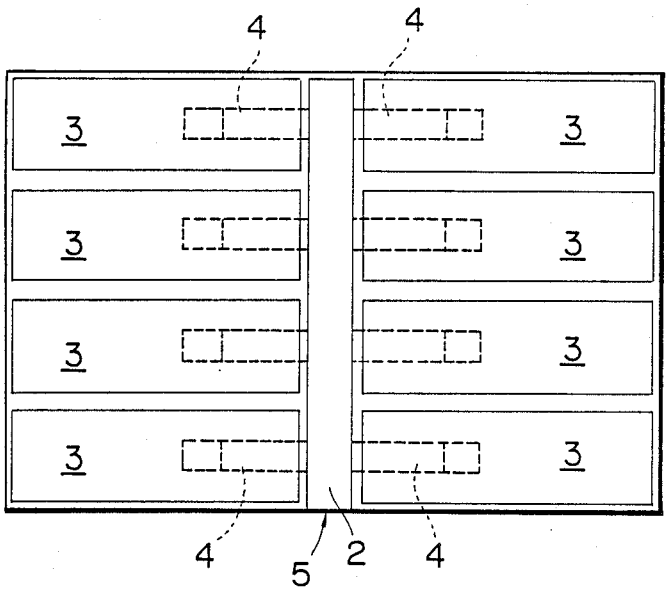
FIG. 7 is a front view of a container for sealingly containing a fluid in accordance with a second embodiment of the present invention.
Figure 8:
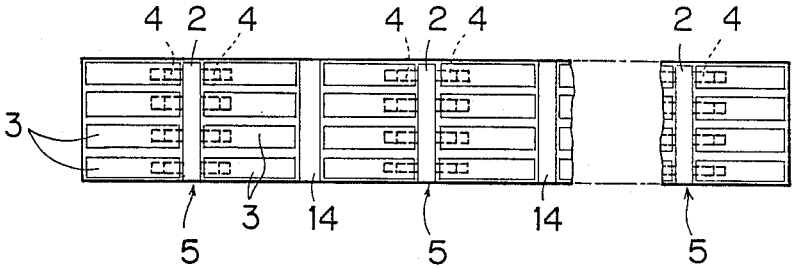
FIG. 8 is a schematic front view of a container for sealingly containing a fluid in accordance with a third embodiment of the present invention.
Figure 9:
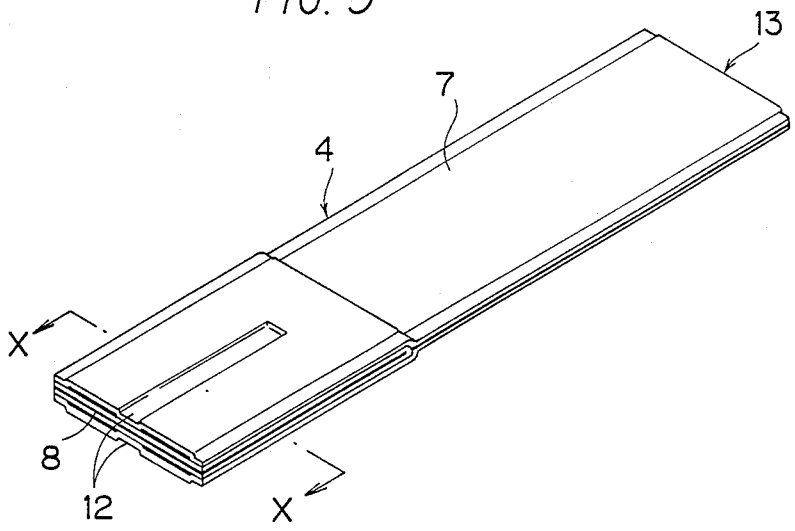
FIG. 9 is a perspective view of a check valve used in the present invention.
Figure 10:
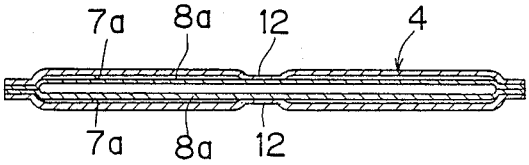
FIG. 10 is an enlarged section view taken along the line X—X in FIG. 9.
Figure 11:
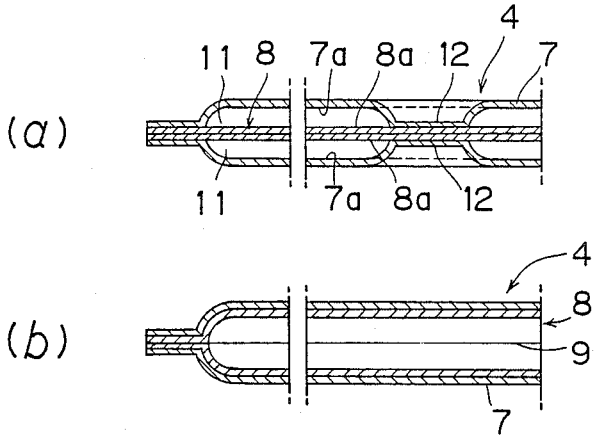
FIG. 11 (*a*) and (*b*) are views illustrating the operation of the check valve when it is used, the view (a) being an enlarged section view of the check valve when a fluid is supplied, and the view (b) being an enlarged section view of the check valve when it is closed.

FIGS. 7 and 8 show the second and third embodiments of the present invention.

The container in FIG. 7 is different from the first embodiment in that a plurality of sac-like container members 3 are disposed at both sides of a guide tube 2.

The container in FIG. 8 is formed by arranging, through connecting portions 14, a plurality of the containers one of which is shown in FIG. 7.

The containers in FIGS. 7 and 8 are suitable to the application requiring a large-size container, but these containers can be used as divided into portions at the guide tube 2 and/or the connecting portion 14, as necessary. Therefore, such containers are suitable for mass production.

Mounting the check valves 4 in the sac-like container members 3 is carried out simultaneously with melting two rectangular thermoplastic films at predetermined portions thereof.

Figure 13:
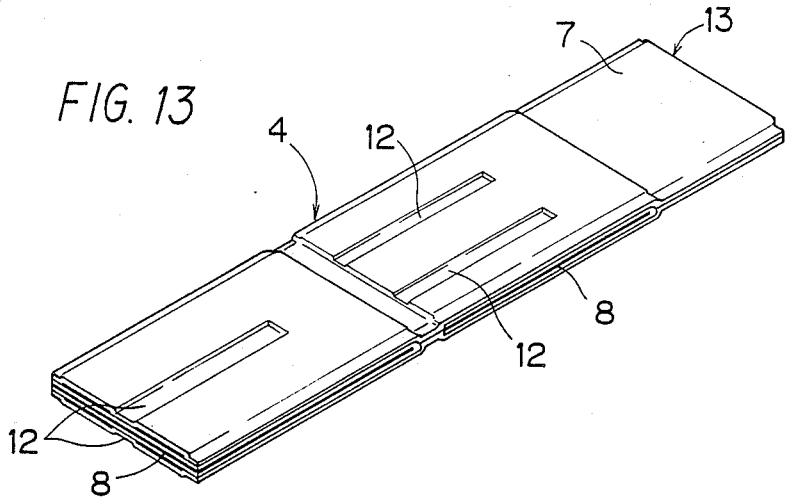
FIG. 13 is a perspective view illustrating another example of the check valve.

Preferred embodiments of the present invention have been discussed and illustrated, but the present invention is not limited to such embodiments. For example, the shape or the like of the guide tube 2 or the sac-like container members 3 disposed at one or both sides thereof may be suitably designed according to the application. Further, two (as shown in FIG. 13) or more valve bodies 8 may be disposed, in series, in the fluid pipe 7 of the check valve 4. That is, all modifications and variations are included in the present invention without departing from the scope of the attached claims.

What is claimed is:

1. A container for sealingly containing a fluid comprising:

first and second thermoplastic container films which are bonded together around a rectangular periphery defining four sides except along a portion of one side adjacent an intersecting side whereby an inlet port is formed;

a first bonded together portion of said container films which extends from said one side adjacent said inlet port to an opposite side, said first bonded portion extending parallel to said intersecting side to form a guide tube open at said inlet port and including a plurality of non-bonded together segments spaced therealong;

a plurality of check valves, each said check valve including two rectangular thermoplastic valve films bonded together along long sides thereof to form a fluid pipe and having a tip opening at one short side and a valve body at the other short side which allows flow through said fluid pipe from said tip opening but which prevents a reverse flow, a respective said check valve being provided at each respective said non-bonded together segment of said first bonded together portion with a respective said valve film bonded at said tip opening to an adjacent said container film whereby said guide tube is fluid tight except for said inlet port and said tip openings; and a plurality of second bonded together portions of said container films, a respective said second bonded together portion being provided between adjacent said check valves and extending from said first bonded together portion of an opposite intersecting side to form a plurality of container members whose only egress is a respective said check valve.

2. A container for sealingly containing a fluid as claimed in claim 1 wherein a width of said second bonded together portions is substantially larger than said first bonded together portion such that said second bonded-together portion is easily cut in half laterally to separate one said container member from an adjacent said container member.

3. A container for sealingly containing a fluid as claimed in claim 1 wherein said valve body is a folded over rectangular thermoplastic film defining two flaps and having a folded portion, opposite free ends, and lateral sides; and wherein respective said lateral sides are bounded to a respective overlapping adjacent said long side of said fluid pipe whereby fluid flowing through said fluid pipe exits said check valve through a respective outlet provided between adjacent said free ends and the associated said valve film.

4. A container for sealingly containing a fluid as claimed in claim 3 and further including an intermediate bonded together portion of a respective said valve film and an adjacent said flap extending from each respective said free end of said flap parallel to said lateral sides to divide each said outlet into two paths.

* * * * *